US007585044B2

(12) United States Patent
Williams et al.

(10) Patent No.: US 7,585,044 B2
(45) Date of Patent: Sep. 8, 2009

(54) METHOD FOR NORMALIZING A PRINTHEAD ASSEMBLY

(75) Inventors: Brian Edward Williams, Wilsonville, OR (US); Terrance L. Stephens, Molalla, OR (US); Matthew Hudson Dixon, Portland, OR (US)

(73) Assignee: Xerox Corporation, Norwalk, CT (US)

( * ) Notice: Subject to any disclaimer, the term of this patent is extended or adjusted under 35 U.S.C. 154(b) by 382 days.

(21) Appl. No.: 11/796,939

(22) Filed: Apr. 30, 2007

(65) Prior Publication Data

US 2008/0266340 A1 Oct. 30, 2008

(51) Int. Cl.
*B41J 29/393* (2006.01)

(52) U.S. Cl. ..... 347/19
(58) Field of Classification Search ..... 347/19
See application file for complete search history.

(56) References Cited

U.S. PATENT DOCUMENTS

| | | | | |
|---|---|---|---|---|
| 5,223,853 | A | 6/1993 | Wysocki et al. | |
| 5,387,976 | A * | 2/1995 | Lesniak | 356/627 |
| 5,502,468 | A | 3/1996 | Knierim | |
| 5,519,419 | A | 5/1996 | Stephany et al. | |
| 7,073,878 | B2 | 7/2006 | Nishida et al. | |
| 2003/0071866 | A1 * | 4/2003 | Wong et al. | 347/19 |
| 2007/0171247 | A1 * | 7/2007 | Kitagawa | 347/15 |

* cited by examiner

*Primary Examiner*—Julian D Huffman
(74) *Attorney, Agent, or Firm*—Maginot, Moore & Beck LLP

(57) ABSTRACT

A method of adjusting an ink jet imaging device comprises measuring a drop parameter for drops generated by each drop generator in a plurality of drop generators. Each drop generator is configured to generate a drop in response to a drop generating signal having a fill portion, an eject portion, and a resonance tuning portion. A first portion of the drops are generated by each drop generator at a first fill density, and a second portion of the drops are generated by each drop generator at a second fill density. A drop parameter difference is measured for each drop generator of the plurality of drop generators of drops generated at the first and second fill densities. The resonance tuning portion of the drop generating signal for at least one drop generator is adjusted so that the drop parameter difference for the drop generator corresponds to the drop parameter difference normalization value.

19 Claims, 7 Drawing Sheets

| HEAD | UNADJUSTED THIRD PULSE VOLTAGE | UNADJUSTED AVERAGE DROP MASS DIFF. | ADJUSTED THIRD PULSE VOLTAGE | ADJUSTED AVERAGE DROP MASS DIFF. |
|---|---|---|---|---|
| A | -6.0 | -3.9 | 0.0 | -3.3 |
| B | -6.0 | -2.5 | -10.5 | -3.3 |
| C | -6.0 | -3.3 | -4.2 | -3.3 |
| D | -6.0 | -2.7 | -9.3 | -2.9 |

120 124 128 130

FIG. 6

METHOD FOR NORMALIZING A PRINTHEAD ASSEMBLY

CROSS-REFERENCE TO RELATED APPLICATIONS

Reference is made to commonly-assigned copending U.S. patent application Ser. No. 11/796787, entitled "BANDING ADJUSTMENT METHOD FOR MULTIPLE PRINTHEADS" by Snyder et al., filed concurrently herewith, the entire disclosure of which is expressly incorporated by reference herein.

TECHNICAL FIELD

This disclosure relates generally to imaging devices that eject ink from ink jets onto print drums to form images for transfer to media sheets and, more particularly, to imaging devices that use phase change inks.

BACKGROUND

Drop on demand ink jet technology for producing printed media has been employed in commercial products such as printers, plotters, and facsimile machines. Generally, an ink jet image is formed by selective placement on a receiver surface of ink drops emitted by a plurality of drop generators implemented in a printhead or a printhead assembly. For example, the printhead assembly and the receiver surface are caused to move relative to each other, and drop generators are controlled to emit drops at appropriate times, for example, by an appropriate controller. The receiver surface can be a transfer surface or a print medium such as paper. In the case of a transfer surface, the image printed thereon is subsequently transferred to an output print medium such as paper. Some ink jet printheads employ melted solid ink.

The image is typically made up of a grid-like pattern of potential drop locations, commonly referred to as pixels. Variations in color may be achieved by selectively depositing ink drops at the potential drop locations by using dithering or halftoning techniques. Dithering, or halftone printing, uses an aggregation of monochromatic dots to produce different shades of gray or other colors. Halftone reproductions rely on the ability of the human eye to integrate a plurality of small black dots on a white background and perceive the dot covered area as a shade of gray. Thus, white areas typically have 0% coverage, and solid color areas have 100% coverage. The percentage coverage, or fill, of an arbitrarily selected unit area may be used to identify the gray level of the unit area. For example, a unit area having one-half of its area covered by ink drops may be defined as having 50% coverage, or 50% fill.

Ink jet printers can produce undesirable image defects in the printed image. One such image defect is non-uniform print density, such as "banding" and "streaking." "Banding" and "streaking" are caused by variabilities in volumes of the ink droplets ejected from different ink drop generators. Such variabilities in ink volume may be caused by variability in the physical characteristics (e.g., the nozzle diameter, the channel width or length, etc.) or the electrical characteristics (e.g., thermal or mechanical activation power, etc.) of the drop generators. These variabilities are often introduced during print head manufacture and assembly.

Methods of reducing banding artifacts caused by nozzle-to-nozzle differences are known. For instance, in some prior art systems drop volume variability between nozzles of a printhead has been reduced by "normalizing" each jet or nozzle within a printhead. Normalization of the printhead nozzles is accomplished by modifying the electrical signals, or driving signals, that are used to activate the individual nozzles so that all of the nozzles of the printhead generate an ink drop having substantially the same drop mass. Normalization of the jets in the printhead may be effective in the generation of substantially uniform drop mass across the nozzles of an individual printhead. In multiple printhead systems, however, the "normalized" drop mass produced may vary from printhead to printhead resulting head-to-head banding defects which may cause noticeable color variations and/or hue shifts and generate images that do not accurately replicate desired colors.

Methods have been developed to address drop volume variation between printheads. For example, U.S. Pat. No. 6,154,227 to Lund teaches a method of adjusting the number of micro-drops printed in response to a drop volume parameter stored in programmable memory on the print head cartridge. Also, U.S. Pat. Nos. 6,450,608 and 6,315,383 to Sarmast et al., teach methods of detecting inkjet nozzle trajectory errors and drop volume using a two-dimensional array of individual detectors. These methods, however, require the use of sophisticated sensors and ink cartridges. The calibration time, cost, and physical space constraints may weigh against the use of these and other possible complex methods.

Another method comprises detecting the average drop mass output by each printhead at a single fill level, such as 100% fill, for example. The average drop mass output by a printhead may then be adjusted to be within specification by uniformly increasing or decreasing the voltage level of the driving signals that activate the drop generators of the printhead. Testing has shown, however, that small head-to-head drop mass variations may be visible throughout dithered fill patterns. Testing has also shown that the average drop mass may vary considerably from head-to-head when printing halftone fill patterns even after drop volume between printheads has been normalized at 100% fill. For example, FIG. 1 is a graph showing drop mass deviation at 25% fill and 100% fill for a printhead assembly that has already had 100% fill drop mass set to within specification. Notice that, although the drop mass variation at 100% is within +/−0.5 ng, the head-to-head drop mass variation at 25% fill is greater than +/−1.5 ng. Specifications may require drop mass variations to be as low as 0.5 ng. Thus, while the 100% fill head-to-head drop mass variation is within specification, the head-to-head drop mass variation at 25% is not. Consequently, the head-to-head drop mass variation at 25% fill may be noticeable to printer operators as head-to-head banding.

SUMMARY

In order to address the difficulties associated with the previously known banding adjustment methods, a method of normalizing an ink jet imaging device at multiple fill densities is provided. The method comprises measuring a drop parameter for drops generated by each drop generator in a plurality of drop generators. Each drop generator is configured to generate at least one drop in response to at least one drop generating signal. Each drop generating signal includes a fill portion, an eject portion, and a resonance tuning portion. A first portion of the drops are generated by each drop generator in the plurality of drop generators at a first fill density, and a second portion of the drops are generated by each drop generator in the plurality of drop generators at a second fill density. The drop parameter is measured at the first fill density for each drop generator in the plurality of drop generators and at the second fill density for each drop generator in the plurality of drop generators. A drop parameter difference is measured for each drop generator of the plurality of drop generators. The drop parameter difference is a difference between the drop parameter measured for one of the drop generators at the first fill density and the drop parameter measured for the same drop generator at the second fill density. A drop parameter difference normalization value is then calculated with reference to the drop parameter differences measured for the plurality of drop generators. The resonance tuning portion of the at least one drop generating signal for at least one drop generator in the plurality of drop generators is then adjusted so that the drop parameter difference for the at least one drop generator corresponds to the drop parameter difference normalization value.

In another embodiment, a method of normalizing an ink jet imaging device having a plurality of printheads comprises ejecting a plurality of drops from a plurality of drop generators. Each drop generator in the plurality of drop generators is configured to eject a drop in response to a drop generating signal having a fill portion, an eject portion and a resonance tuning portion. A first portion of the plurality of drops is ejected at a first fill density and a second portion of the plurality of drops is ejected at a second fill density. A drop parameter of the first portion of the plurality of drops for each drop generator in the plurality of drop generators is measured, and the drop parameter of the second portion of the plurality of drops for each drop generator in the plurality of drop generators is measured. A drop parameter difference for each drop generator in the plurality of drop generators is then measured. The drop parameter difference is a difference between the drop parameter measured for one of the drop generators at the first fill density and the drop parameter measured for the same drop generator at the second fill density. The resonance tuning portion of the at least one drop generating signal for at least one drop generator in the plurality of drop generators is then adjusted so that the drop parameter difference is approximately the same for each drop generator in the plurality of drop generators.

BRIEF DESCRIPTION OF THE DRAWINGS

The foregoing aspects and other features of a printer implementing a banding adjustment for multiple printheads are explained in the following description, taken in connection with the accompanying drawings, wherein:

FIG. 6 is a table showing unadjusted and adjusted third pulse voltages and drop mass differences for an ink jet imaging device having four printheads.

DETAILED DESCRIPTION

Figure 2:
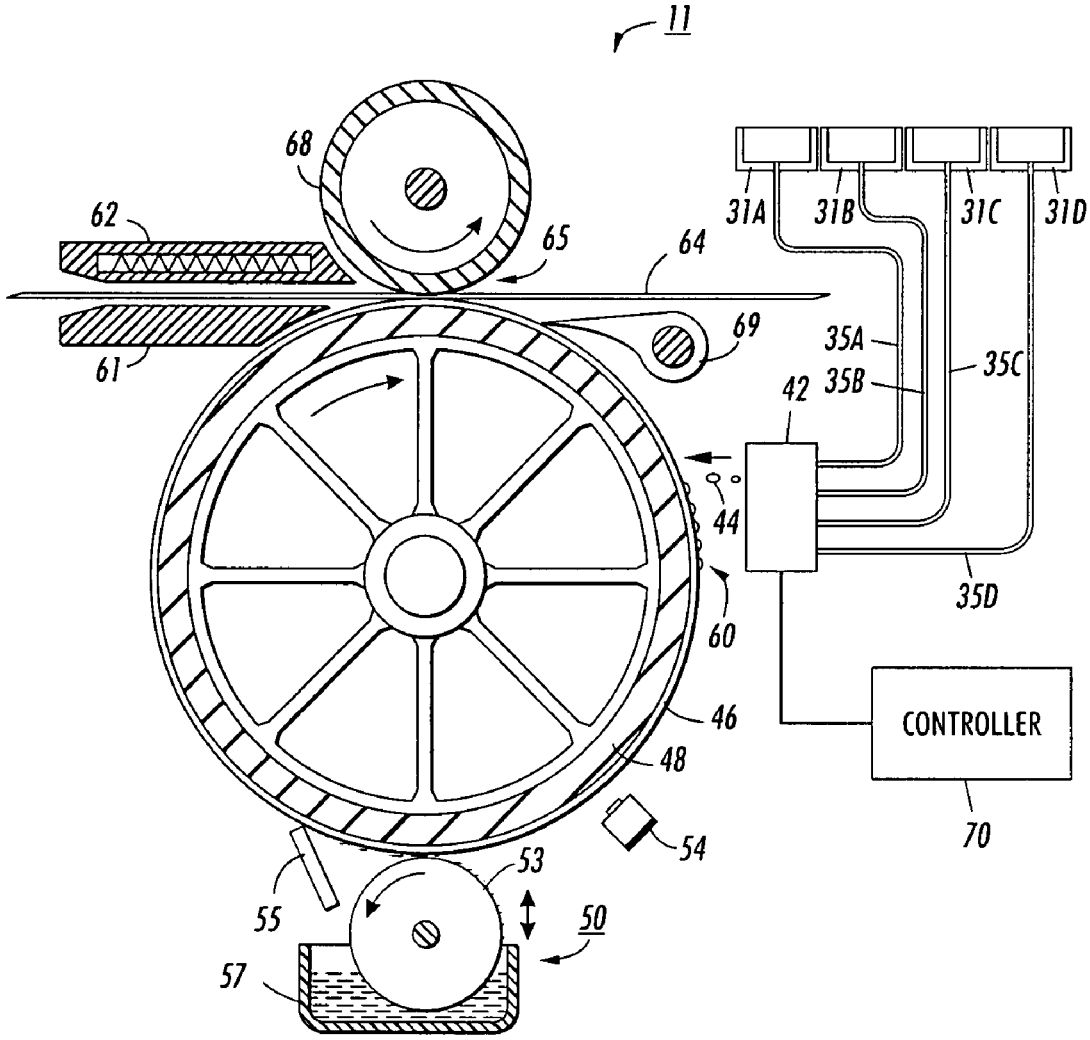
FIG. 2 is a schematic diagram of an embodiment of an ink jet imaging device.

Referring to FIG. 2, a schematic view of an imaging system 11 is shown. For the purposes of this disclosure, the imaging system is in the form of an ink jet printer that employs one or more ink drop generators and an associated ink supply. As used herein, a drop generator may comprise any device capable of emitting one or more drops of ink. For example, in one embodiment, a drop generator may comprise a printhead that includes a plurality of ink jets for emitting drops of ink. Alternatively, a drop generator may comprise an individual ink jet of a printhead.

The present disclosure is applicable to any of a variety of other imaging apparatus, including for example, laser printers, facsimile machines, copiers, or any other imaging apparatus capable of applying one or more colorants to a medium or media. The imaging apparatus may include an electrophotographic print engine, or an inkjet print engine. The colorant may be ink, toner, or any suitable substance that includes one or more dyes or pigments and that may be applied to the selected media. The colorant may be black, or any other desired color, and a given imaging apparatus may be capable of applying a plurality of distinct colorants to the media. The media may include any of a variety of substrates, including plain paper, coated paper, glossy paper, or transparencies, among others, and the media may be available in sheets, rolls, or another physical formats.

FIG. 2 is a schematic block diagram of an embodiment of an ink jet printing mechanism 11. The printing mechanism includes a printhead assembly 42 that is appropriately supported to emit drops 44 of ink onto an intermediate transfer surface 46 applied to a supporting surface of an imaging member 48 that is shown in the form of a drum, but can equally be in the form of a supported endless belt. In other embodiments, the printhead assembly may eject drops of ink directly onto a print media substrate, without using an intermediate transfer surface. The ink is supplied from the ink reservoirs 31A, 31B, 31C, 31D of the ink supply system through liquid ink conduits 35A, 35B, 35C, 35D that connect the ink reservoirs with the printhead 42. The intermediate transfer surface 46 may be a liquid layer such as a functional oil that can be applied by contact with an applicator such as a roller 53 of an applicator assembly 50. By way of illustrative example, the applicator assembly 50 can include a metering blade 55 and a reservoir 57. The applicator assembly 50 may be configured for selective engagement with the print drum 48.

The exemplary printing mechanism 11 further includes a substrate guide 61 and a media preheater 62 that guides a print media substrate 64, such as paper, through a nip 65 formed between opposing actuated surfaces of a roller 68 and the intermediate transfer surface 46 supported by the print drum 48. Stripper fingers or a stripper edge 69 can be movably mounted to assist in removing the print medium substrate 64 from the intermediate transfer surface 46 after an image 60 comprising deposited ink drops is transferred to the print medium substrate 64.

Operation and control of the various subsystems, components and functions of the device 11 are performed with the aid of a controller 70. The controller 70 may be a self-contained, dedicated computer having a central processor unit (CPU) (not shown), electronic storage (not shown), and a display or user interface (not shown). The controller 70 is the main multi-tasking processor for operating and controlling other machine subsystems and functions, including timing and operation of the printhead assembly as described below.

Figure 3:
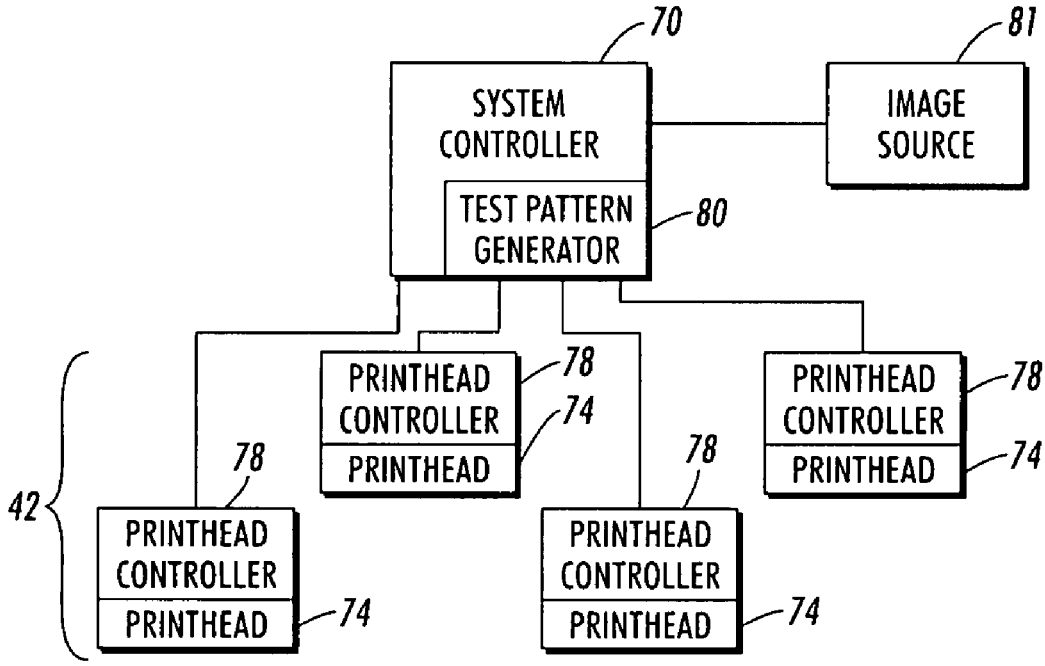
FIG. 3 is a schematic diagram of the printhead assembly and controller of the ink jet imaging device of FIG. 1.

FIG. 3 is a schematic diagram of an embodiment of a printhead assembly 42 and controller. The printhead assembly 42 may include a plurality of printheads 74. FIG. 2 shows an embodiment of a printhead assembly having four printheads 74. The printheads may be arranged end-to-end in a direction transverse to the receiving surface path in order to cover different portions of the receiving surface. The end-to-end arrangement enables the printheads 74 to form an image across the full width of the image transfer surface of the imaging member or a substrate.

Figure 1:
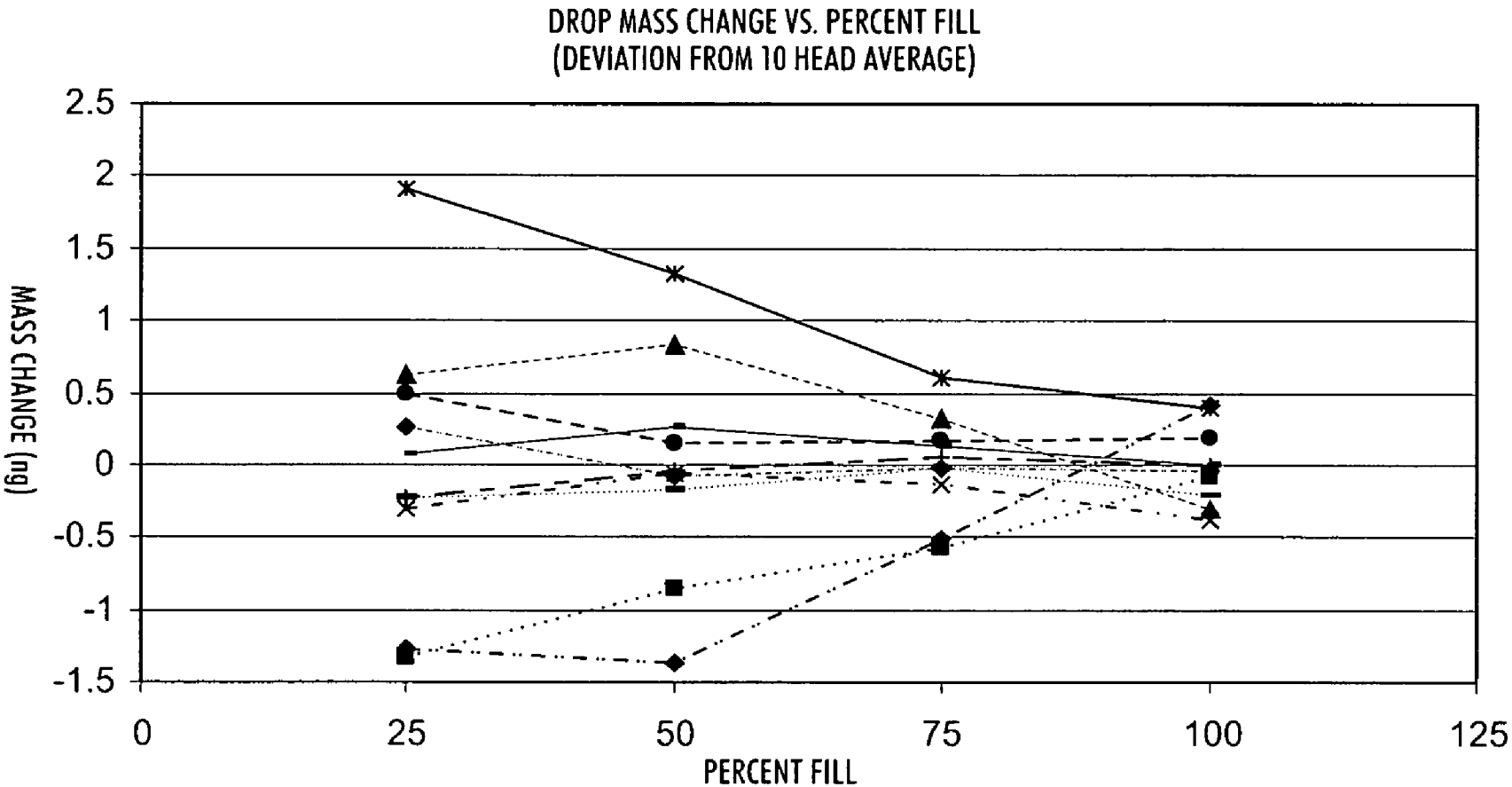
FIG. 1 is a graph of drop mass change versus percent fill for an imaging device having a plurality of printheads.

Each printhead 74 may be configured to emit ink drops of each color utilized in the imaging device. For example, a color printer typically uses four colors of ink (yellow, cyan, magenta, and black). Thus, each printhead may include an array of yellow ink jets, an array of cyan ink jets, an array of magenta ink jets, and an array of black ink jets. Thus, each printhead is configured to receive ink from each color sources 31A-D (FIG. 1). In another embodiment, the print head assembly 42 may include a print head for each composite color. For example, a color printer may have one print head for emitting black ink, another print head for emitting yellow ink, another print head for emitting cyan ink, and another print head for emitting magenta ink.

The operation of each printhead is controlled by one or more printhead controllers 78. In the embodiment of FIG. 3, there is provided one printhead controller 78 for each printhead. The printhead controllers 78 may be implemented in hardware, firmware, or software, or any combination of these. Each printhead controller may have a power supply (not shown) and memory (not shown). Each printhead controller 78 is operable to generate a plurality of driving signals for causing selected individual ink jets (not shown) of the respective printheads to eject drops of ink 44. An exemplary printhead includes a plurality of such ink jets. The printhead controllers selectively energize the ink jets by providing a respective drive signal to each ink jet. Each ink jet employs an ink drop ejector that responds to the drive signal. Exemplary ink drop ejectors include piezoelectric transducers, and in particular, ceramic piezoelectric transducers. As other examples, each of the ink jets can employ a shear-mode transducer, an annular constrictive transducer, an electrostrictive transducer, an electromagnetic transducer, or a magneto restrictive transducer.

To facilitate calibration of the printhead assembly 42 (explained in more detail below), the controller 70 may include a test pattern generator 80 configured to generate calibration, or test, images. Such test images include patches printed by one or more of the printheads at predetermined coverage levels. For example, the controller may be configured to generate test images having solid fill areas and/or dithered fill areas. Dithered fill areas may be defined as areas, or patches, having a percent fill that is less than 100% fill. Solid or dithered fill test images may be printed using a single primary color or a plurality of primary colors that form a secondary color.

During operations, the controller 70 receives print data from an image data source 81. The image data source 81 can be any one of a number of different sources, such as a scanner, a digital copier, a facsimile device, or a device suitable for storing and/or transmitting electronic image data, such as a client or server of a network, or onboard memory. The print data may include various components, such as control data and image data. The control data includes instructions that direct the controller to perform various tasks that are required to print an image, such as paper feed, carriage return, print head positioning, or the like. The image data are the data that instructs the print head to mark the pixels of an image, for example, to eject one drop from an ink jet print head onto an image recording medium. The print data can be compressed and/or encrypted in various formats.

The controller 70 generates the printhead image data for each printhead 74 of the printhead assembly 42 from the control and print data received from the image source 81, and outputs the image printhead data to the appropriate printhead controller 78. The printhead image data may include the image data particular to the respective printhead. In addition, the printhead image data may include printhead control information. The printhead control information may include information such as, for example, instructions to adjust the average drop mass generated by a particular printhead. The printhead controllers 78 upon receiving the respective control and print data from the controller, generate driving signals for driving the ink jets to expel ink in accordance with the print and control data received from the controller. Thus, a plurality of drops may be ejected at specified positions and at specified fill levels on the image receiving member in order to produce an image in accordance with the print data received from the image source.

The controller 70 may be configured to determine an average drop mass output by each printhead of the printhead assembly. The average drop mass output by each printhead 74 may be determined or detected in any suitable manner as known in the art. In one known method, the average drop mass output by each printhead may be determined by detecting the quantity of ink entering a printhead while printing an image and simultaneously determining the number of ink drops ejected from the printhead to print the image. Many printers currently count the number of ink drops ejected from the printhead for various purposes. Therefore, the ink drop count information may be made available to the printer controller. The mass of ink entering the printhead may be determined by detecting the mass of the ink passing a particular point in the ink delivery system of the printer. From the determined quantity of ink entering the printhead and the determined number of ink drops ejected from the printhead, the average drop mass output by a printhead may be determined. In an example, the mass of the ink entering a printhead during a specified time is detected, from which the average mass of each ink drop is determined by dividing the mass of the ink entering the printhead by the number of drops ejected from the printhead during that specified time.

Figure 4:
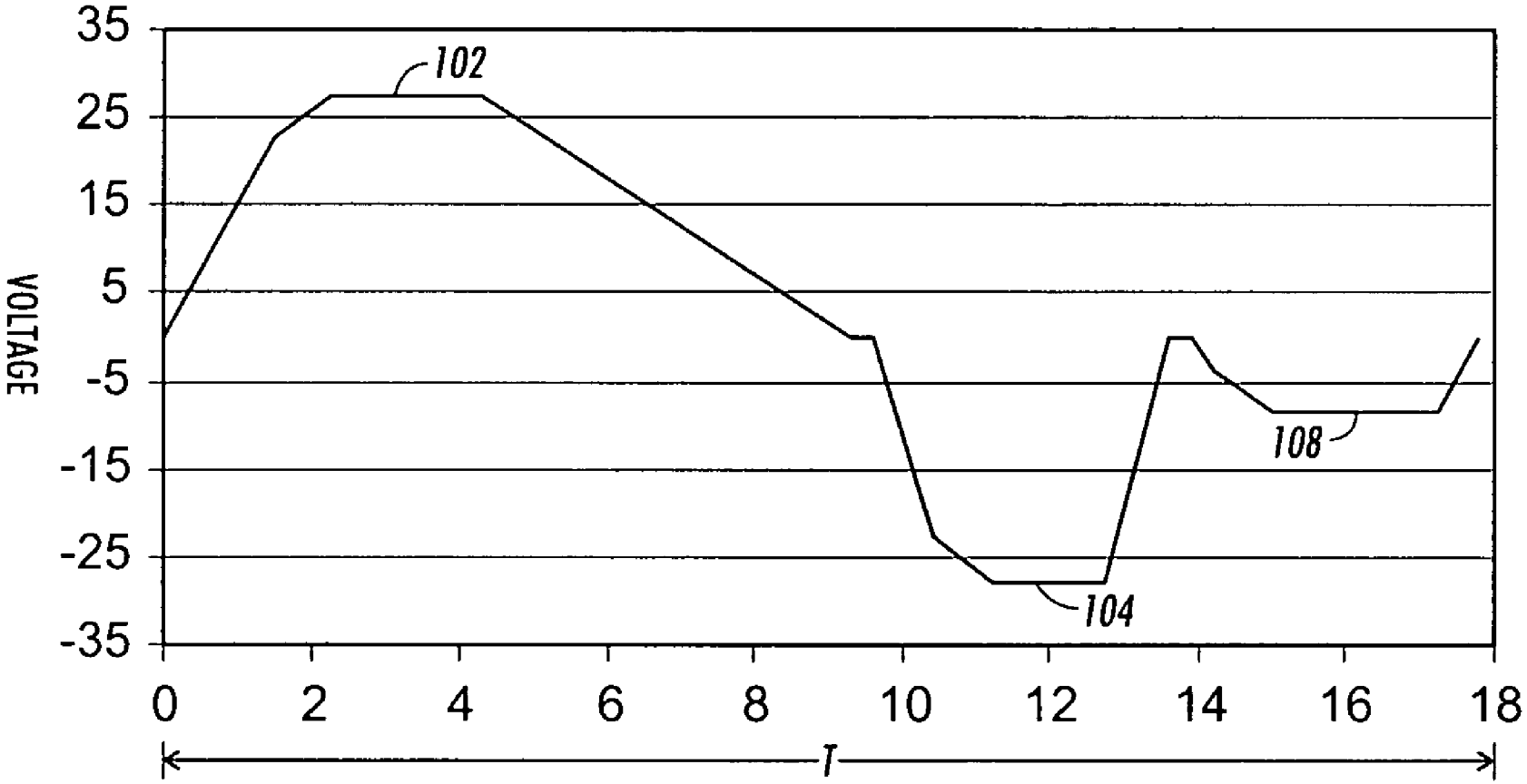
FIG. 4 is a diagram of an embodiment of a drive waveform for causing a drop to be emitted by a drop generator.

In accordance with at least one embodiment, a driving signal applied to the transducers of the ink jets may be a waveform signal. An exemplary driving signal 100 is illustrated in FIG. 4. A drive signal, or waveform, 100 may be provided to an ink jet in a firing interval T to cause an ink drop to be emitted. The firing interval T may be in the range of about 100 microseconds to about 25 microseconds, such that the ink jet may be operated at a drop firing frequency in the range of about 10 KHz to about 40 KHz for the example wherein the firing interval T is substantially equal to the reciprocal of the drop firing frequency.

The drive signal 100 of FIG. 4 is a waveform that includes a fill pulse 102 and an ejection pulse 104. The pulses 102 and 104 are voltages of opposite polarity of possibly different magnitudes. The polarities of the pulses 102, 104 may be reversed from that shown in FIG. 4, depending upon the polarization of the piezoelectric driver. In operation, upon the application of the fill pulse 102, the ink chamber expands and draws ink into the chamber for filling the chamber following the ejection of a drop. As the voltage falls toward zero at the end of the fill pulse, the ink chamber begins to contract and moves the ink meniscus toward an orifice or nozzle of an ink jet. Upon the application of the eject pulse 104, the ink chamber is rapidly constricted to cause the ejection of a drop of ink.

In addition to the fill and eject pulses, the drive signal of FIG. 4 may include a reset pulse 108. The reset pulse 108 occurs after a drop is emitted and may function to reset the ink jet so that subsequent drops have substantially the same mass and substantially the same velocity as the previously emitted drop. The reset pulse 108 may be of the same polarity as the preceding pulse 104 in order to "pull" the meniscus at the nozzle inwardly to help prevent the meniscus from breaking. If the meniscus breaks and ink oozes out of the nozzle, the ink jet can fail to emit drops on subsequent firings.

Many parameters affect the performance of ink jets. Temperature non-uniformities across a print head may produce variations in ink viscosity for the different jets of the print head. Drop production is affected by driver efficiency, which changes according to parameters such as, for example, thickness of the layer of piezoelectric material, stiffness of the diaphragm and the piezoelectric material, and density and piezoelectric constant of the piezoelectric material. Because of the limited control over these and other ink jet parameters, jet performance may vary from jet to jet. By adjusting the waveform of the drive signal applied to an ink jet, drop size and/or velocity may be altered and variations in jet performance may be partially compensated.

In order to adjust or modulate the drop volume of drops ejected by the ink jets, the voltage level, or amplitude, of one or more segments, or pulses, of the driving signal may be varied. In one embodiment, in order to increase or decrease the drop mass of a drop emitted by an ink jet, the amplitude, or voltage level, of the entire waveform may be increased or decreased accordingly. Alternatively, in order to adjust the emitted drop mass of an ink jet, the amplitude of one or both of the fill pulse and the eject pulse may be adjusted.

The natural resonant frequencies of a printhead may also affect the ejection of ink drops from an ink jet. Resonance frequencies of a printhead may include the meniscus resonance frequency, Helmholtz resonance frequency, piezoelectric drive resonance frequency, various acoustic resonance frequencies of the different channels and passageways forming the ink jet print head, and coupled resonances that may comprise combinations of two or more different resonance frequencies. These resonant frequencies may affect the ejection of ink droplets from the ink jet orifice in several ways, including, but not limited to, ink drop mass and the drop ejection velocity. In order to minimize the effect of the different resonance frequencies on drop formation, the drive signal may be adjusted in order to concentrate energy at frequencies near a resonance frequency of a desired mode and suppress energy at the natural frequencies of other modes. By exciting a particular resonance frequency of a printhead, the affect of the resonant frequencies of other resonance modes on drop formation may be minimized.

In one embodiment, the reset pulse component 108 of the drive waveforms 100 may be configured as a resonance tuning pulse. The amplitude, or voltage level, of the resonance tuning pulse may be adjusted in order to excite a drop mass resonance of a printhead. The drop mass resonance may be a coupled resonance that includes the mechanical resonance of the piezoelectric transducer, the fluidic resonance of ink in the ink chamber, and the resonance of the drive waveform. By increasing or decreasing the amplitude of the resonance tuning pulse 108 of the drive waveform, the drop mass resonance may be excited and other resonances of the printhead may be suppressed.

Adjusting the resonance tuning pulse 108 of a drive signal has been shown to have an effect on the print quality of drops output by an ink jet at different fill densities. For example, the drop intensity, drop mass, drop velocity, etc. output by an ink jet at a first fill density may be different than the drop intensity, drop mass, drop velocity, etc output by the ink jet at a second fill density that is different than the first fill density. The differences in drop parameters may be due to the various resonant frequencies of a printhead that may be excited at the different fill densities. Adjusting the resonance tuning pulse of the drive signal for an ink jet has been shown to have an affect on the difference in drop parameters of drops output by an ink jet at different fill levels. For example, increasing the amplitude of the resonance tuning pulse, or reset pulse, of a drive signal for an ink jet may decrease a difference in the drop parameter, e.g. intensity, mass, etc., of drops output at different fill levels, such as, for example, 100% fill and 25% fill.

As part of a setup or maintenance routine, each printhead 74 of the printhead assembly 42 may undergo a normalization process as is known in the art to ensure that each ink jet of a printhead ejects ink drops having substantially the same print quality. Print quality of drops ejected from the printheads may be related to a number of drop parameters such as, for example, mass, velocity, and intensity. Processes for measuring or detecting print quality parameters such as mass, velocity, and intensity of emitted ink drops are known. Once a print quality parameter has been detected, or measured, for each ink jet of a printhead, a determination may be made whether the print quality parameter of each ink jet meets predetermined ink drop criteria. If the drop parameter does not meet the predetermined ink drop criteria, such as the ink drop mass is outside of a specified mass range, the ink jets may be calibrated to return the ink drop to the predetermined ink drop criteria. For example, the voltage level, or amplitude, of one or more segments, or pulses, of the driving signals may be selectively varied to adjust the print quality of drops emitted by each ink jet. The normalized voltage levels of the driving signals may be saved in memory for the respective printhead controller to access. Once the voltage level of the driving signals has been normalized for each printhead, the normalized driving signals may be recorded by each printhead controller so that the normalized voltages may be used to subsequently drive the ink jets.

In one exemplary embodiment, the ink jet imaging device may include a drop intensity sensor 54 (See FIG. 2) for detecting an intensity of drops emitted by the ink jets. The drop intensity sensor 54 may comprise a light emitting diode (LED) for directing light onto drops ejected onto an image receiving surface, and a light detector, such as a CCD sensor, for detecting an intensity of light reflected from drops emitted by each ink jet. Thus, a drop intensity value may be detected that corresponds to each ink jet. The detected drop intensity value for each ink jet of a printhead may be compared to a predetermined threshold value or range to determine if each ink jet is emitting drops of the specified intensity. If the drop intensity of an ink jet does not meet the desired intensity level, the drive signal intended for that ink jet may be adjusted accordingly. For example, to increase intensity of drops emitted by a select ink jet, the voltage level of the driving waveform may be increased. Each ink jet of a printhead may be, thus, normalized to generate drops having similar print quality. Drop mass, intensity, velocity, etc. may be normalized in this manner across the ink jets of a printhead.

While normalization of the jets in the printhead may be effective in the generation of substantially uniform print quality across the nozzles of an individual printhead, the "normalized" print quality produced may vary from printhead to printhead in a multiple printhead system resulting in unsatisfactory image quality. Methods for normalizing drop parameters between printheads of a multiple printhead system are known. For example, one such method comprises detecting the average drop mass output by each printhead at a single fill level, or setpoint, typically solid, or 100%, fill. The average drop mass output by a printhead may then be adjusted to within specification by uniformly increasing or decreasing the voltage level of the driving signals that activate the ink jets of the printhead so that the average drop mass for each printhead is within specification at solid fill patterns. Testing has shown, however, that small head-to-head drop mass variations may be visible throughout dithered fill patterns even after normalization after printheads drive signals have been set at solid fill patterns.

Figure 5:
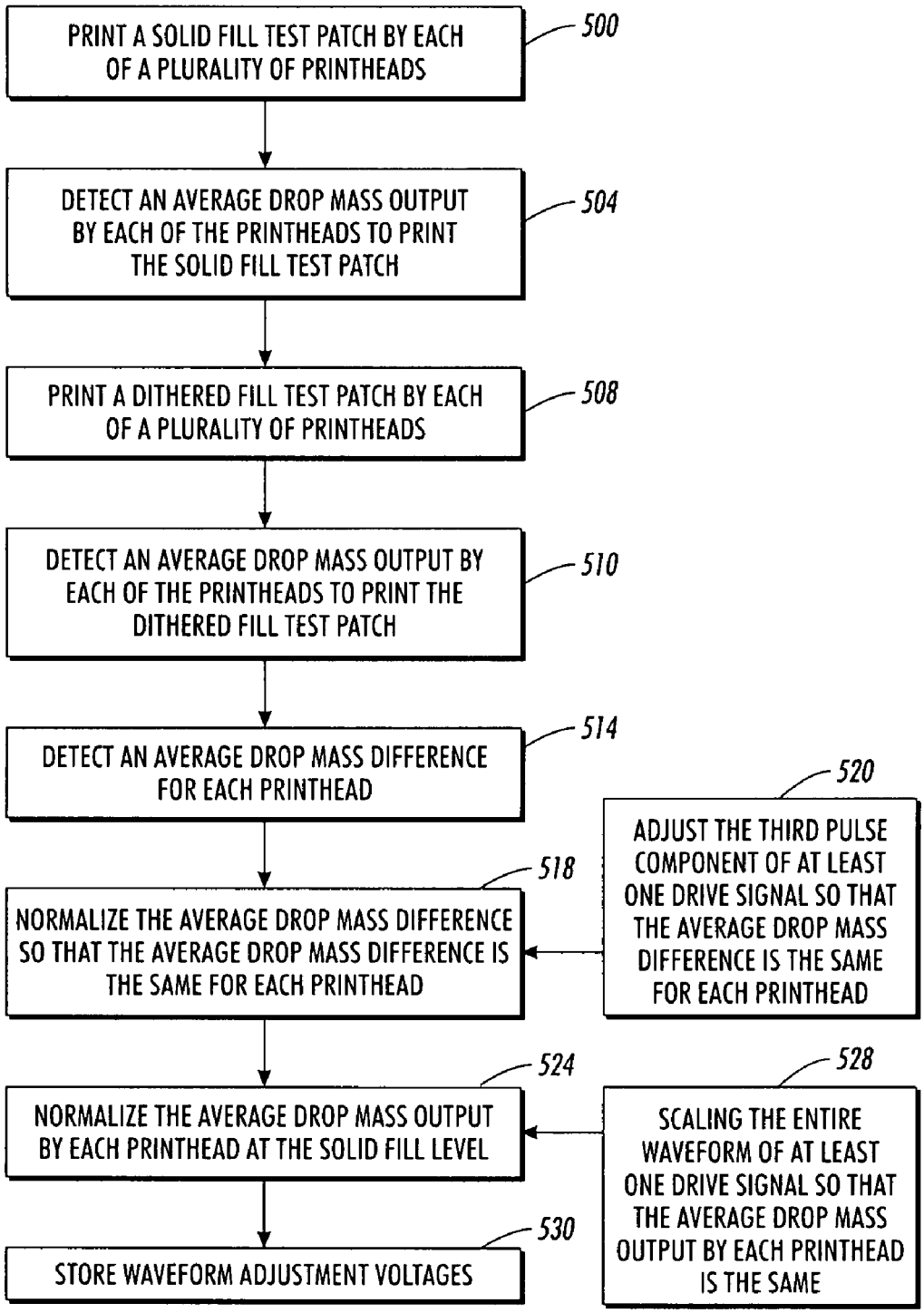
FIG. 5 is flowchart of a method for normalizing an average drop mass output by a printhead assembly having a plurality of printheads at two fill densities.

Referring to FIG. 5, there is shown a flowchart of an embodiment of a method for normalizing an ink jet imaging device having a plurality of printheads at least two fill setpoints, or percent fill levels. The method comprises printing a test patch by each of a plurality of printheads, each test patch being printed at a first fill setpoint (block 500). A test patch may be printed for each color used in the imaging device. Each printhead of the plurality of printheads is used to print a test patch. Alternatively, a test band may be printed in which each printhead prints a portion of the test band. The first fill setpoint may be any suitable fill density. In the method shown in FIG. 4, the first fill density may be substantially solid fill, or 100% fill.

An average drop mass output by each of the printheads to print the test patch at the first fill level is detected (block 504). The average drop mass output by each printhead may be detected as described above. For example, the average drop mass for each printhead may be detected by detecting the amount of ink that enters the printhead and simultaneously detecting the number of times the ink jets of the printhead were fired while printing the test patch. The average drop mass may then correspond to the ratio of the ink entering the printhead to the number of drops fired to print the test patch.

A test patch is then printed by each of the plurality of printheads at a second fill setpoint (blodk 508). The second fill setpoint is different than the first fill setpoint. In one embodiment, the second fill setpoint is approximately a 25% fill density although any suitable fill level may be used. An average drop mass output by each printhead to print the test patches at the second fill density is then detected (block 510). Thus, an average drop mass at the first fill density and an average drop mass at the second fill density are determined for each printhead of the printhead assembly.

An average drop mass difference may then be determined for each printhead (block 514) by calculating the difference between the average drop mass at the first fill density and the average drop mass at the second fill density for each printhead. For example, if the average drop mass detected for a first printhead at the first fill density is 5 ng and the average drop mass detected for the first printhead at the second fill density is 4 ng, then the average drop mass difference for the first printhead may be 5 ng-4 ng, or 1 ng. The average drop mass difference may be determined for each printhead in this manner.

Once the average drop mass difference is detected for each printhead, the average drop mass difference may then be normalized such that the average drop mass difference is substantially the same for each printhead (block 518). In one embodiment, the average drop mass difference may be normalized by tuning the drop mass resonance of each printhead so that the average drop mass difference is approximately the same for each printhead. Drop mass resonance may be, in turn, tuned by adjusting the third pulse component, or resonance tuning component, of the drive signals for each ink jet of one or more of the printheads (block 520).

In one embodiment, the average drop mass difference may be normalized by determining a drop mass difference normalization value. In one embodiment, the average drop mass normalization value corresponds to the detected drop mass differences. Determining an average drop mass normalization value corresponding to the measured average drop mass differences may be determined, or calculated, using any suitable method. For example, the average drop mass difference normalization value may be calculated as an average, or weighted average, of the average drop mass differences of the printheads. In another embodiment, the drop mass normalization value may be a predetermined value that is stored in memory, for example, or programmed into the controller. The average drop mass difference normalization value may be a single value or range of values.

Once a suitable average drop mass normalization value has been determined, the resonance tuning components of the drive signals for each ink jet of one or more of the printheads may be adjusted so that the average drop mass difference of at least one of the printheads corresponds to the average drop mass difference normalization value. In one embodiment, a uniform resonance adjustment voltage may be determined for each printhead. The uniform resonance adjustment voltage comprises the voltage level used to uniformly adjust the amplitude of the third pulse components of the drive signals for each ink jet of a printhead so that the average drop mass difference for each printhead is approximately the same. The uniform resonance adjustment voltage may be different for each printhead. For example, to decrease the average drop mass difference for a printhead, the amplitude, or voltage level, of the resonance tuning component, or third pulse component, of the drive signals for each ink jet may be increased by the uniform resonance adjustment voltage. Depending on the actual components and construction of the printhead assembly, there may be a linear relationship between the voltage level of the third pulse of the driving signal and the drop mass difference. For example, in one embodiment, the drop mass difference may be decreased by approximately 0.13 ng for each volt increase in the amplitude of the third pulse of the drive signal. The relationship, however, need not be linear.

Normalizing the average drop mass difference for each printhead may require iterations. For example, after a first round of adjustments have been made to the resonance tuning components of the drive signals for each ink jet of one or more printheads in accordance with the detected average drop mass difference for each printhead, the process may be repeated. A new set of test patches may be printed at the first setpoint, and an average drop mass may be detected for each printhead at the first setpoint. A new set of test patches may be printed at the second setpoint, and an average drop mass may be detected for each printhead at the second setpoint. The average drop mass difference for each printhead may then be determined and further adjustments to the resonance tuning components of the drive signals may then be made if necessary.

The table in FIG. 6 shows the measured drop mass differences between 100% fill and 25% fill drop masses in a printhead assembly having four printheads A, B, C, D prior to normalization. In particular, the first column 120 of the table shows the average voltage level of the third pulse of the drive waveforms for each ink jet of the printhead. The second column 124 shows the difference in average drop mass measured at 100% and 25% fill levels for each printhead. Within the four printheads, the variation in the average drop mass difference of the printheads was measured as high as 1.4 ng. Thus, in this example, the average drop mass at 25% fill may vary by as much as 1.4 ng from head to head. A drop mass variation of 1.4 ng may be result in noticeable banding and streaking in an image.

The third column 128 shows the average voltage level of the third pulse, or resonance tuning component, of the drive signals for each printhead after a single round of adjustments. The fourth column 130 shows the average drop mass difference for each printhead after the first round of adjustments. In this embodiment, three out of the four printheads had the same average drop mass difference and the head to head drop mass difference variation had been reduced by 70%.

Once the average drop mass difference has been normalized for each printhead of the printhead assembly and the uniform resonance adjustment voltage for each printhead has been determined, the average drop mass output by each printhead may be normalized at the first setpoint (block 524). The average drop mass output by each printhead may be adjusted by uniformly adjusting the voltage level of the entire drive waveform, including the already adjusted resonance tuning component (block 528). Thus, a drop mass scaling voltage may then be determined for each printhead that corresponds to the adjustment voltage level used to configure each printhead to output approximately the same average drop mass at the first setpoint.

As an example, a test patch may be printed by each printhead at the first setpoint coverage density. The average drop mass output by each printhead may then be determined as described above. To increase or decrease the average drop mass output by a printhead, the voltage level, or amplitude, of the entire drive waveform for each ink jet of a printhead may be uniformly adjusted by a drop mass scaling voltage. For instance, to increase the average drop mass of a printhead, the voltage level or amplitude of each driving signal of the printhead may be increased by the waveform scaling voltage. The drop mass scaling voltage may be different for each printhead.

Similar to normalizing the average drop mass difference, normalizing the average drop mass for each printhead at the first setpoint may require one or more iterations. The voltage level of the third pulse of a drive signal may be either positive or negative after being adjusted to set the drop mass difference between the chosen setpoints, or fill patterns. Once the uniform third resonance adjustment voltage and the drop mass scaling voltage has been determined for each printhead, a waveform scaling voltage may then be determined for each printhead. The waveform scaling voltage includes a first pulse adjustment voltage, a second pulse adjustment voltage and a third pulse adjustment voltage. The first and second pulse adjustment voltages for each printhead may correspond to the drop mass scaling voltage for each printhead. The third pulse scaling voltage for each printhead may correspond to the sum of the drop mass scaling voltage and the uniform resonance adjustment voltage for each printhead. Thus, an adjustment voltage may be determined and stored (block 530) that allows the controller to subsequently drive the printheads at a desired level in accordance with the waveform scaling voltages for each printhead.

Thus, a method of normalizing a printhead assembly from printhead to printhead at two fill setpoints has been described. The method comprises adjusting the third pulse, or resonance tuning component, of the drive signals in order to normalize an average drop mass difference between the first and second setpoints, or fill levels, for the printheads. Once the average drop mass difference between the first and second fill levels is approximately the same for each printhead, the average drop mass output at the first setpoint may be normalized so that each printhead outputs approximately the same average drop mass at the first fill level. Because the average drop mass at the first fill level is approximately the same and because the difference between the average drop mass between the first and second fill levels is approximately the same for each printhead, the average drop mass output by each printhead at the second fill level may be about the same. Therefore, the printhead assembly may be normalized for two setpoint fill patterns.

Figure 7:
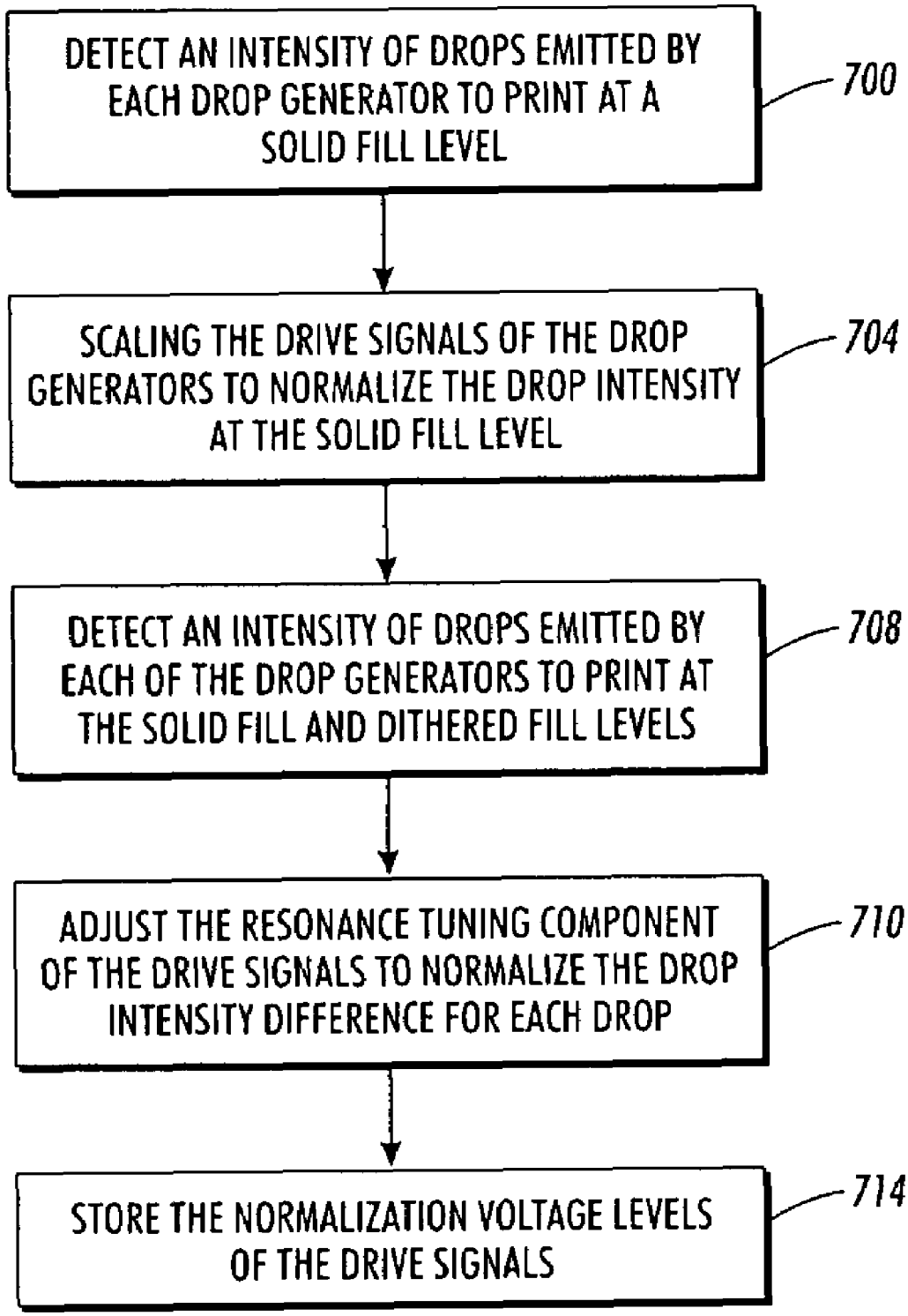
FIG. 7 is a flowchart of a method of normalizing jet-to-jet drop intensity for a plurality of drop generators at two fill densities.

As an alternative to using the third pulse, or resonance tuning component, of the drive signals to adjust for head-to-head drop mass variations, the third pulse component may be used to adjust for drop intensity variations from jet-to-jet. Therefore, instead of measuring and adjusting an average drop mass output by each printhead, the intensity of drops emitted by individual jets may be measured and adjusted. Referring to FIG. 7, a flowchart of a method of normalizing jet-to-jet intensity at two setpoints is shown. The method comprises printing a test patch at a first setpoint, or fill level. An intensity value is then detected for each ink jet of each printhead that corresponds to the detected intensity of the drops output by a respective ink jet (block 700). The intensity value may be detected using the intensity sensor described above.

The drive signals for the ink jets may then be normalized so that the drop intensity of drops emitted by each of the ink jets is approximately the same at the first setpoint, typically 100% fill. The normalization may be accomplished in manner similar to that described above as part of the set or maintenance routine. For example, the voltage level of the drive signals may be selectively scaled, or adjusted so that each ink jet emits drops of the same intensity (block 704). The entire waveform may be scaled, or, alternatively, the fill and/or eject components may be adjusted. Thus, a first normalized drive signal is determined for each ink jet for printing at the first setpoint. The first normalized drive signals of the ink jets are configured to cause drops to be emitted of substantially the same intensity. Once the first normalized drive signals are determined, they may be stored in memory.

Once the ink jets have been normalized at the first setpoint, the drop intensity may be normalized at a second setpoint, such as, for example, 25% fill. In one embodiment, the ink jets may be normalized at the second setpoint by determining a difference in intensity of drops emitted by the ink jets at the first setpoint and drops emitted by the ink jets at the second setpoint, and adjusting the third pulse, or resonance tuning component of one or more of the drive signals so that the difference in drop intensity at the two setpoint levels is approximately the same for each ink jet.

Thus, in one embodiment, a second solid fill test patch is printed and the intensity of drops emitted by each ink jet is determined. A test patch is then printed at a second setpoint, and an intensity value is then detected for each ink jet at the second fill level. An intensity difference is then determined for each ink jet that corresponds to the difference between the intensity value at the first fill level and the intensity value at the second fill level (block 708). The intensity difference may be normalized from jet-to-jet by adjusting the third pulse, or resonance tuning, component of one or more of the drive signals so that the intensity difference is substantially the same for each ink jet (block 710). For example, to decrease the intensity difference for an ink jet, the amplitude, or voltage level, of the resonance tuning component, or third pulse component, of the respective drive signal may be increased. Thus, a second normalized drive signal may be determined for the ink jets that includes an adjusted third pulse voltage. The second normalized drive signal may be used by the respective printhead controllers to drive the ink jets when printing at the second setpoint.

Once the first and second normalized drive signals, or normalized voltage levels of the drive signals, have been determined, the first and second normalized drive signals may be recorded by each printhead controller so that the first and second normalized voltages may be used to subsequently drive the ink jets at the desired level (block 714). Thus, when printing at the first setpoint, the printhead controllers may access and use the first normalized drive signals for driving the ink jets, and when printing at the second setpoint, the printhead controllers may access and use the second normalized drive signals for driving the ink jets.

Those skilled in the art will recognize that numerous modifications can be made to the specific implementations described above. For example, the normalization method set out above may be used with any ink jet imaging device, including those that use solid ink. Therefore, the following claims are not to be limited to the specific embodiments illustrated and described above. The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others.

What is claimed is:

1. A method of adjusting an ink jet imaging device, the method comprising:

measuring a drop parameter for drops generated by each drop generator in a plurality of drop generators, each drop generator being configured to generate at least one drop in response to at least one drop generating signal, each drop generating signal including a fill portion, an eject portion, and a resonance tuning portion, a first portion of the drops generated by each drop generator in the plurality of drop generators being at a first fill density and a second portion of the drops generated by each drop generator in the plurality of drop generators being at a second fill density, the drop parameter being measured at the first fill density for each drop generator in the plurality of drop generators and at the second fill density for each drop generator in the plurality of drop generators;

measuring a drop parameter difference for each drop generator of the plurality of drop generators, the drop parameter difference being a difference between the drop parameter measured for one of the drop generators at the first fill density and the drop parameter measured for the same drop generator at the second fill density;

calculating a drop parameter difference normalization value with reference to the drop parameter differences measured for the plurality of drop generators; and adjusting the resonance tuning portion of the at least one drop generating signal for at least one drop generator in the plurality of drop generators so that the drop parameter difference for the at least one drop generator corresponds to the drop parameter difference normalization value.

2. The method of claim 1, the adjustment of the resonance tuning portion of that at least one drop generating signal further comprising:

adjusting the resonance tuning portion of the at least one drop generating signal for at least one drop generator in the plurality of drop generators so that the drop parameter difference for each of the drop generators in the plurality of drop generators corresponds to the drop parameter difference normalization value.

3. The method of claim 2, the first fill density comprising an approximately 100% fill density.

4. The method of claim 3, the second fill density comprising an approximately 25% fill density.

5. The method of claim 2, each of the plurality of drop generators comprising a printhead, each printhead including a plurality of ink jets, each ink jet of the plurality of ink jets being configured to emit a drop in response to a drop generating signal.

6. The method of claim 5, the drop parameter comprising an average drop mass of drops generated by each printhead of the plurality, the average drop mass being measured for each printhead of the plurality at the first fill density and for each printhead of the plurality at the second fill density.

7. The method of claim 6, the adjustment of the resonance tuning portion further comprising:

adjusting a voltage amplitude of the resonance tuning portion of the drop generating signal for each ink jet of the plurality of ink jets of at least one printhead so that the average drop mass difference for each printhead of the plurality of printheads corresponds to the average drop mass difference normalization value.

8. The method of claim 7, further comprising:

recording the adjusted voltage amplitude of the resonance tuning portion of the drop generating signal for each ink jet of the plurality of ink jets of the at least one printhead as a default voltage amplitude of the resonance tuning portion of the drop generating signal for each ink jet of the plurality of ink jets of the at least one printhead.

9. The method of claim 8, further comprising:

subsequent to the adjustment of at least one resonance tuning portion of the at least one drop generating signal, scaling the voltage amplitude of the entire drop generating signal for each ink jet of the plurality of ink jets of the at least one printhead so that the average drop mass for each printhead of the plurality of printheads corresponds to an average drop mass normalization value.

10. The method of claim 9, further comprising:

recording the scaled voltage level of the entire drop generating signal for each ink jet of the plurality of ink jets of the at least one printhead as default voltage levels.

11. The method of claim 1, each drop generator of the plurality of drop generators comprising an ink jet, each ink jet of plurality being configured to emit a drop in response to a drop generating signal.

12. The method of claim 1, the drop parameter comprising an intensity of drops emitted by each of the ink jets.

13. The method of claim 1, the adjustment of the resonance tuning signal portion of at least one of the drop generating wave signals further comprising:

adjusting a voltage level of the resonance tuning portion of the drop generating signal for at least one ink jet so that the drop intensity delta for each of the ink jets approximates the drop intensity difference normalization value.

14. The method of claim 13, further comprising:

storing the voltage level of the adjusted resonance tuning portions of the drop generating signals.

15. A method of adjusting a printhead assembly including a plurality of printheads, the method comprising:

ejecting a plurality of drops from a plurality of drop generators, each drop generator in the plurality of drop generators being configured to eject a drop in response to a drop generating signal having a fill portion, an eject portion and a resonance tuning portion, a first portion of the plurality of drops being ejected at a first fill density and a second portion of the plurality of drops being ejected at a second fill density;

measuring a drop parameter of the first portion of the plurality of drops for each drop generator in the plurality of drop generators;

measuring the drop parameter of the second portion of the plurality of drops for each drop generator in the plurality of drop generators;

measuring a drop parameter difference for each drop generator in the plurality of drop generators, the drop parameter difference being a difference between the drop parameter measured for one of the drop generators at the first fill density and the drop parameter measured for the same drop generator at the second fill density; and adjusting the resonance tuning portion of the at least one drop generating signal for at least one drop generator in the plurality of drop generators so that the drop parameter difference is approximately the same for each drop generator in the plurality of drop generators.

16. The method of claim 15, each of the plurality of drop generators comprising a printhead, each printhead including a plurality of ink jets, each ink jet of the plurality of ink jets being configured to emit a drop in response to a drop generating signal.

17. The method of claim 16, the drop parameter comprising an average drop mass of drops generated by each printhead of the plurality, the average drop mass being measured for each printhead of the plurality at the first fill density and for each printhead of the plurality at the second fill density.

18. The method of claim 15, each drop generator of the plurality of drop generators comprising an ink jet, each ink jet of plurality being configured to eject a drop in response to a drop generating signal.

19. The method of claim 18, the drop parameter comprising an intensity of drops emitted by each of the ink jets.

* * * * *